US007731763B2

(12) United States Patent
Fernandez Cid et al.

(10) Patent No.: US 7,731,763 B2
(45) **Date of Patent: *Jun. 8, 2010**

(54) METHOD OF DYEING A SUBSTRATE WITH A REACTIVE DYESTUFF IN SUPERCRITICAL OR NEAR SUPERCRITICAL CARBON DIOXIDE

(75) Inventors: Maria Vanesa Fernandez Cid, Haarlem (NL); Geert Jan Witkamp, Bergschenhoek (NL); Geert Feye Woerlee, Haarlem (NL); Wilhelmus Johannes Theodorus Veugelers, Kessel (NL)

(73) Assignee: Feyecon Development & Implementation B.V., Weesp (NL)

( * ) Notice: Subject to any disclaimer, the term of this patent is extended or adjusted under 35 U.S.C. 154(b) by 0 days.

This patent is subject to a terminal disclaimer.

(21) Appl. No.: 11/718,699

(22) PCT Filed: Nov. 4, 2005

(86) PCT No.: PCT/NL2005/050031

§ 371 (c)(1),
(2), (4) Date: Jun. 29, 2007

(87) PCT Pub. No.: WO2006/107191

PCT Pub. Date: Oct. 12, 2006

(65) Prior Publication Data

US 2008/0028541 A1 Feb. 7, 2008

(30) Foreign Application Priority Data

Nov. 4, 2004 (EP) ..... 04078035

(51) Int. Cl.
*D06P 1/94* (2006.01)
*D06P 1/38* (2006.01)

(52) U.S. Cl. ..... 8/475; 8/474; 8/543; 8/594; 8/602; 8/614; 8/615; 8/918; 8/920

(58) Field of Classification Search ..... 8/636, 8/474, 475, 543, 594, 602, 614, 615, 918, 8/920

See application file for complete search history.

(56) References Cited

U.S. PATENT DOCUMENTS

| | | | |
|---|---|---|---|
| 5,578,088 | A | 11/1996 | Schrell et al. |
| 6,010,542 | A | 1/2000 | DeYoung et al. |
| 6,620,211 | B2 | 9/2003 | Veugelers et al. |
| 2001/0020311 | A1 | 9/2001 | Veugelers et al. |

FOREIGN PATENT DOCUMENTS

| | | | |
|---|---|---|---|
| DE | 199 37 328 | A1 | 3/2000 |
| EP | 1 126 072 | A2 | 8/2001 |
| JP | 2002004169 | * | 1/2002 |

OTHER PUBLICATIONS

Schmidt, A. et al., "The dyeing of natural fibres with reactive disperse dyes in supercritical carbon dioxide", *Dyes and Pitments*, vol. 56, No. 1, pp. 27-36, Jan. 2003.

* cited by examiner

*Primary Examiner*—Lorna M Douyon
*Assistant Examiner*—Amina Khan
(74) *Attorney, Agent, or Firm*—Gilberto M. Villacorta; Sunit Talapatra; Foley & Lardner LLP

(57) ABSTRACT

The present invention relates to a method of dyeing a substrate with a reactive dyestuff in supercritical or near supercritical carbon dioxide, said substrate being selected from the group consisting of cellulose fibers; modified cellulose fibers; protein fibers; synthetic fibers and any combination thereof, wherein the method comprises dyeing said substrate by contacting the substrate with supercritical or near supercritical carbon dioxide containing a reactive dyestuff and one or more acids in a concentration of at least 0.05 mol. %, calculated on the molar amount of reactive dyestuff that is used in the dyeing method, said reactive dyestuff being a chromophore derivative containing a chromophoric residue and a reactive group, said reactive group comprising a cyclic or heterocyclic aromatic residue that will be protonated under the conditions employed during the contacting, such protonation resulting in enhanced reactivity of the reactive dyestuff towards the plurality of reactive groups contained in the substrate.

20 Claims, No Drawings

METHOD OF DYEING A SUBSTRATE WITH A REACTIVE DYESTUFF IN SUPERCRITICAL OR NEAR SUPERCRITICAL CARBON DIOXIDE

TECHNICAL FIELD OF THE INVENTION

The present invention relates to a method of dyeing a substrate, particularly fibers, with a reactive dyestuff in supercritical or near supercritical carbon dioxide.

BACKGROUND OF THE INVENTION

Dyeing by traditional water-based methods and subsequent washing processes produces large amounts of, usually strongly coloured, waste water. Furthermore, when dyeing, for instance, polyester fibers from an aqueous medium, the dyed fibers need to be subjected to a so called reduction clearing which causes additional effluent problems.

The aforementioned environmental drawbacks of water-based dyeing methods can be overcome by dyeing from supercritical carbon dioxide. Supercritical dyeing additionally offers the advantage that densities and viscosities in supercritical carbon dioxide are lower and diffusion more rapid than in liquids, shortening the process time.

The dyeing of substrate materials in liquid or supercritical carbon dioxide is well-known in the art. It is also known to employ reactive dyeing substances in supercritical dyeing methods that are capable of reacting with the substrate under the formation of a chemical bond. These reactive substances are usually derivatives of $CO_2$-soluble disperse dyestuffs (chromophores) that contain a reactive group that is capable of reacting with specific residues in the substrate.

U.S. Pat. No. 6,620,211 describes a method for dyeing textile material with one or more fibre-reactive disperse dyestuffs in a supercritical or almost supercritical fluid, wherein the relative humidity of the fluid is in the range of 10-100% during dyeing. It is observed in the patent that maintaining the relative humidity of the fluid in the range from 10 to 100% during the dyeing process ensures that the textile material remains sufficiently moist and therefore sufficiently accessible for the uptake of the dyestuff. In the patent it is observed that the moistening agent may contain a reaction-accelerating auxiliary for accelerating the reaction between the reactive disperse dyestuff and the textile material. Examples of these auxiliaries are said to include pyridine and ammonium salts. It is said that these reaction accelerators often contain tertiary and quaternary ammonium groups.

U.S. Pat. No. 6,010,542 describes a method of dyeing a substrate in carbon dioxide comprising the steps of (a) providing a dye composition comprising carbon dioxide, a dye and a surfactant, the surfactant being included in an amount sufficient to solubilise, emulsify or disperse the dye in the carbon dioxide, and then (b) dyeing said substrate with said dye composition. According to the US patent the method enables the use of relatively large and less volatile dyes in carbon dioxide mediated dyeing systems. Furthermore, it is said that the method does not require high temperatures and pressures for sufficient dissolution of the dye. The patent provides a long list of additives that may be employed with the carbon dioxide, including carboxylic acids.

The results obtained with supercritical dyeing methods described in the prior art are not entirely satisfactory. In particular, the colour yields and wash-fastening properties of the dyed substrate are often disappointing.

SUMMARY OF THE INVENTION

The inventors have unexpectedly found that substantially better results can be obtained from supercritical dyeing methods by selecting specific reactive dyestuffs and by employing carbon dioxide that besides the reactive dyestuff contains a significant quantity of acids. Consequently, the method according to the invention is characterised in that it comprises dyeing a fibre substrate by contacting the substrate with supercritical or near supercritical carbon dioxide containing a reactive dyestuff and one or more acids in a concentration of at least 0.05 mol.%, calculated on the molar amount of reactive dye substance that is used in the dyeing process. The reactive dyestuff employed in accordance with the present invention is a chromophore derivative containing a chromophoric residue and a reactive group, said reactive group comprising a cyclic or heterocyclic aromatic residue that will be protonated under the conditions employed during dyeing, such protonation resulting in enhanced reactivity of the reactive dyestuff towards the plurality of reactive groups contained in the substrate.

The present method provides excellent fixation of the dyestuff in combination with exceptionally high reaction rates. Furthermore, the present method enables the production of dyed substrates that exhibit outstanding washfastness and fastness to rubbing. An important advantage of the present method is that very good dyeing results can be obtained without prior chemical modification of the substrate.

It is believed that the acidification of the carbon dioxide in accordance with the invention promotes protonation of the reactive group of the reactive dyestuff. As a result the reactive dyestuff will be activated and react much more rapidly with the reactive groups in the substrate.

DETAILED DESCRIPTION OF THE INVENTION

Accordingly, the present invention relates to a method of dyeing a substrate with a reactive dyestuff in supercritical or near supercritical carbon dioxide, said substrate being selected from the group consisting of cellulose fibers; modified cellulose fibers; protein fibers; synthetic fibers containing a plurality of reactive groups selected from the group consisting of hydroxyl, thiol, primary amine and secondary amine; and combinations of these fibers, wherein the method comprises dyeing said substrate by contacting the substrate with supercritical or near supercritical carbon dioxide containing a reactive dyestuff and one or more acids in a concentration of at least 0.05 mol.%, preferably at least 0.2 mol.%, calculated on the molar amount of reactive dyestuff substance that is used in the dyeing method, said reactive dyestuff being a chromophore derivative containing a chromophoric residue and a reactive group, said reactive group comprising a cyclic or heterocyclic aromatic residue that will be protonated under the conditions employed during the contacting, such protonation resulting in enhanced reactivity of the reactive dyestuff towards the plurality of reactive groups contained in the substrate.

The fibre substrate in the present method can suitably tale the shape of yarn or fabric. The present method is particularly suitable for dyeing fabrics, e.g. woven or knitted fabrics.

The term "acids" as user herein refers to an organic or inorganic substance that is capable of donating a proton to the reactive dyestuff under the conditions employed in the present dying method.

The term "reactive dyestuff" as used in here refers to dyestuffs, which are capable of reacting and forming a covalent bond with reactive groups in the substrate under the conditions employed in the present method. Examples of reactive groups include hydroxyl groups (cellulose based materials such as cotton), amino and thiol groups (wool, silk, polyamides).

The term "supercritical carbon dioxide" as used in here refers to carbon dioxide that exhibits a pressure and temperature equal to or above its critical pressure and critical temperature (73.8 bar; 31.1° C.). The dyeing method according to the present invention can also employ carbon dioxide under near supercritical conditions, i.e. at a pressure of at least 50 bar and a temperature of at least 15 ° C.

The term "chromophoric residue" as used in here refers to the part of the reactive dyestuff molecule that is primarily responsible for its colouring imparting properties. Reactive dyes that may be used to carry out the present invention include, but are not limited to, triazine derivatives of azo (mono, di, poly), carbonyl, sulphur, methine, and triarylcarbonium dyes. Examples of specific reactive dyes that may suitably be employed in the present method include triazine derivatives of azo, anthraquinone, mordant and benzothiazoleazo disperse dyes.

The one or more acids employed in accordance with this embodiment of the invention preferably exhibit an acid dissociation constant K at 25° C. within the range of $4\times10^{-7}$ to $1\times10^{7}$, more preferably within the range of $1\times10^{-6}$ to $1\times10^{1}$, most preferably within the range of $7.2\times10^{-4}$ to $6\times10^{-1}$.

In case the present method employs a strong acid, a relatively low acid concentration may be employed whereas much higher concentrations of a weak acid may be required to achieve the same effect. Thus, in a preferred embodiment, the one ore more acids employed in the method meet the following requirement: $K\times C\geqq0.01$; wherein K represents the acid dissociation constant at 25° C. and C represents the molar concentration of dissolved acids in the carbon dioxide. Even more preferably the present method fulfils the requirement $K\times C\geqq0.03$. In case the carbon dioxide contains more than one acid, the above equation is applied to each acid and the results are added up to produce the final number.

The one or more acids are advantageously selected from the group consisting of HCl, $C_6H_5SO_3H$, $HNO_3$, $CF_3COOH$, $H_3PO_3$, $HClO_2$, $H_3PO_4$, $CH_2ClCOOH$, HF, $HNO_2$, HCOOH, $C_6H_5COOH$, $CH_3COOH$ and $H_2CO_3$.

Excellent results may be obtained with the present method without using a $CO_2$/Dye-philic surfactant as defined in U.S. Pat. No. 6,010,542. Hence, in a preferred embodiment, the present method does not employ a dyeing composition comprising carbon dioxide, a dye and a $CO_2$/Dye-philic surfactant.

According to a particularly preferred embodiment of the invention the reactive dyestuff employed is a chromophore derivative containing a chromophoric residue and a reactive group, said reactive group comprising a cyclic or heterocyclic aromatic residue that has been substituted with at least one radical selected from the group consisting of halide, substituted or unsubstituted alkoxy, substituted or unsubstituted amine, substituted or unsubstituted thiol. In a particularly preferred embodiment the aforementioned reactive group is a substituted triazine, especially a halide substituted triazine.

Particularly good results have been obtained with the present method if it employs a reactive dyestuff of the formula (I):

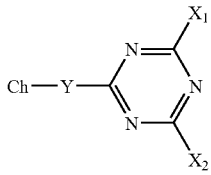

wherein

Ch represents a chromophoric residue;

Y represents O or NR, in which R represents hydrogen or a $C_1$-$C_8$ alkyl, which is optionally substituted by hydroxy, cyano, chloro, bromo, $C_1$-$C_5$ alkoxy, phenoxy, phenyl or phenoxy $C_1$-$C_4$-alkoxy;

$X_1$ represents a halide;

$X_2$ represents fluorine, chlorine, $OR_1$, $SR_1$, $N(R_2)R_3$ or $P(O)(OH)R_{04}$;

$R_1$ represents hydrogen, or a $C_1$-$C_4$ alkyl, which is optionally substituted by hydroxy, cyano, fluorine, chlorine or bromine;

$R_2$ and $R_3$ independently represent hydrogen, $P(O)(OH)R_4$ or a $C_1$-$C_3$ alkyl which is optionally substituted by hydroxy, cyano, fluorine, chlorine or bromine; and $R_4$ represents hydroxy, fluorine, chlorine or bromine.

According to a particularly preferred embodiment of the invention the chromophoric residue in the reactive dyestuff is a residue of an aromatic diazo substance or an anthraquinone substance. Even more preferably, the residue Ch represents an arylazoarylamino residue wherein each of the aryl groups can carry 1-5 substituents.

In the aforementioned formula (I) $X_1$ preferably represents fluorine or chlorine, most preferably it represents fluorine.

In the aforementioned formula (I) $X_2$ preferably represents fluorine, chlorine, $OR_1$ or $N(R_2)R_3$. More preferably, $X_2$ represents fluorine, $(NH)R_2$ or $OR_1$. Most preferably, $X_2$ represents fluorine, $OCH_3$, $OCH_2CH_3$, $NH_2$ or $NHCH_3$.

In another preferred embodiment of the invention $R_1$ represents a $C_1$-$C_3$ alkyl, which is optionally substituted by hydroxy, cyano, fluorine, chlorine or bromine. Even more preferably, $R_1$ represents a $C_1$-$C_3$ alkyl, which is optionally substituted by hydroxy, fluorine or chlorine. Most preferably, $R_1$ represents methyl or ethyl.

In formula (I) Y preferably represents NR. The residue R in NR preferably represents hydrogen or a $C_1$-$C_5$ alkyl, which is optionally substituted by hydroxy, cyano, chloro, bromo or $C_1$-$C_3$ alkoxy. Even more preferably, R represents hydrogen, methyl or ethyl. Most preferably, R represents hydrogen.

As explained herein before, the method of the present invention offers the important advantage that it produces excellent results without the need to chemically modify the substrate prior to the dyeing. Thus, in a preferred embodiment, the present method does not employ pre-treatment of the substrate with one or more compounds containing amino groups as described in U.S. Pat. No. 5,578,088. In an even more preferred embodiment, the present method does not employ any chemical modification of the substrate prior to the dyeing. Here the term "chemical modification" refers to the alteration of the chemical nature of the substrate by allowing reactive groups in the substrate to react with a modifying agent.

Pre-treatment in the form of chemical modification is not to be confused with pre-treatment with inert materials, e.g. organic liquids. Indeed, in a particularly preferred embodiment of the present method, the substrate is pre-treated with a fluid medium containing at least 10 wt.%, preferably at least 20 wt.% and more preferably at least 40 wt.% of one or more organic hydrogen bond acceptor compounds with 1-10 carbon atoms, said hydrogen bond acceptor compounds containing organic one or more functionalities selected from hydroxyl, ester, ketone, sulfoxide, sulfone, ether, amine oxide, tertiary amide, phosphate, carbonate, carbamate, urea, phosphine oxide and nitrile, prior to contacting the substrate with supercritical or near supercritical carbon dioxide containing the reactive dyestuff. Here the term "fluid medium" encompasses liquid as well as supercritical media. Pre-treatment with a fluid medium containing the aforementioned hydrogen bond acceptor compounds was found to substantially improve fastening of the dyestuff to the substrate. Although the inventors do not wish to be bound by theory, it is believed that such pre-treatment makes the reactive sites in the substrate more accessible to the reactive dyestuff. Furthermore, the pre-treatment appears to have a favourable effect on the reaction rate.

The pre-treatment according to the present invention may suitably be carried out by rinsing or soaking the substrate in the fluid medium. The subsequent step of contacting the substrate with supercritical or near supercritical carbon dioxide containing the reactive dyestuff may be effected by simply adding the supercritical or near supercritical carbon dioxide or by separating the substrate from the fluid medium and subsequently adding the carbon dioxide. It is preferred to first separate the substrate from the fluid medium before the dyeing step. Following removal of the substrate from the fluid medium some of the fluid medium clinging to the substrate may be removed by e.g. wiping, wringing or evaporation. However, it is strongly preferred that a significant amount of the fluid medium remains attached to the substrate when it is contacted with the carbon dioxide containing the reactive dyestuff. Typically, when contacted with the reactive dyestuff, the substrate contains at least 25%, preferably at least 50% of fluid medium by weight of the substrate (including said fluid medium).

According to a preferred embodiment, the hydrogen bond acceptor compounds employed in the pre-treatment are selected from the group consisting of $C_1$-$C_6$ alkanols, dimethyl sulfoxide, dimethylformamide, acetone, butan-2-one, dimethyl ether, methyl acetate and ethyl acetate. More preferably, the hydrogen bond acceptor compounds are selected from the group of $C_1$-$C_5$ alkanols, particularly $C_1$-$C_5$ alkanols comprising not more than 2 hydroxyl groups, even more particularly $C_1$-$C_5$ alkanols comprising one hydroxyl group. Especially suited hydrogen bond acceptor compounds are primary alcohols, secondary alcohols and combinations thereof. Examples of alcohols that may advantageously be employed in the pre-treatment of the substrate include methanol, ethanol, propanol, iso-propanol, n-butanol and 2-butanol.

The one or more hydrogen bond acceptors are advantageously employed in the pretreatment in an amount of at least 30%, preferably at least 50% by weight of the substrate. In one particular embodiment of the invention, the present pre-treatment is carried out with a fluid medium essentially consisting of one or more organic hydrogen bond acceptor compounds. In another embodiment, the fluid medium employed in the pre-treatment may suitably contain other fluid components beside the hydrogen bond acceptor compounds. Examples of fluid components that may be included additionally are densified carbon dioxide, water, $C_1$-$C_8$ alkanes, acetone and acetonitrile. Preferably, the fluid medium employed in the treatment essentially consists of a blend of the hydrogen bond acceptor compounds and a fluid component selected from the group consisting of densified carbon dioxide, water, $C_1$-$C_8$, alkanes, acetonitrile and combinations thereof. Even more preferably, the latter fluid component is selected from the group consisting of densified carbon dioxide, acetonitrile and combinations thereof. Most preferably, the fluid component is densified carbon dioxide, especially supercritical or near supercritical carbon dioxide. The use of a mixture of the hydrogen bond acceptor compounds and supercritical or near supercritical carbon dioxide offers the advantage that pre-treatment and dyeing may be carried out in the same equipment.

The pre-treatment step is suitably carried out at a temperature of 5-160° C. and a pressure of 0.5-300 bar. In case the fluid medium does not contain densified carbon dioxide, pre-treatment is preferably carried out at a temperature of 5-50° C. and a pressure of 0.5-2 bar.

During pre-treatment the substrate is preferably contacted with the fluid medium for at least 5 minutes, more preferably for at least 10 minutes and most preferably for at least 15 minutes. Furthermore, the substrate is advantageously pre-treated employing a substrate to medium ratio (w/w) of 1:1 to 1:100, more preferably of 1:1 to 1:10.

In another preferred embodiment of the present method, the supercritical or near supercritical carbon dioxide contains between 1 and 35% by weight of carbon dioxide of a co-solvent selected from the group consisting of one or more organic hydrogen bond acceptor compounds with 1-10 carbon atoms, said hydrogen bond acceptor compounds containing organic one or more functionalities selected from hydroxyl, ester, ketone, sulfoxide, sulfone, ether, amine oxide, tertiary amide, phosphate, carbonate, carbamate, urea, phosphine oxide and nitrile. The use of a co-solvent offers the advantage that it accelerates transfer of the reactive dye to the substrate and improves the reaction of the dyestuff with the substrate. Unlike the method described in U.S. Pat. No. 6,620,211 the present method does not require the use of carbon dioxide exhibiting a relatively high humidity. More particularly, it is preferred to employ carbon dioxide with a relative humidity of less than 10%.

According to preferred embodiments of the invention the co-solvent is selected from the same group of hydrogen bond acceptor compounds as defined above in relation to the embodiment using a pre-treatment step. In case the present method employs such a pre-treatment step, the co-solvent is preferably identical to the hydrogen bond acceptor compound that was used in the pre-treatment.

The invention is further illustrated by means of the following examples:

EXAMPLES

Example 1

A piece of 0.25 g of mercerized cotton was pre-treated in a fluid medium consisting of 20 g of methanol as hydrogen bond acceptor. The pre-treatment was carried out at 40° C. and 1 bar by immersing the cotton in the methanol and gently shaking for 12 h. The pre-treated cotton was removed from the fluid medium and transferred as such for dyeing treatment. The remaining methanol in the cotton after the pre-treatment was about 60% by weight of the cotton substrate The dyeing test was carried out in a high-pressure batch reactor designed to carry out experiments under supercritical conditions. The reactor consisted of a 150 mL pressure vessel provided with a pressure manometer and a needle valve.

The piece of pre-treated cotton was placed into the batch reactor together with the reactive disperse dye (6-fluoro-N-[4-(phenyldiazenyl)phenyl]-1,3,5-triazine-2,4-diamine), a co-solvent and an acid. The amount of dye used was 10% by weight of the fibre (owf). The applied co-solvent was isopropanol at a concentration of 2% by weight of carbon dioxide. The concentration of the acid, $H_3PO_4$, was 4 mol.% calculated on the molar amount of reactive dye substance, so the requirement, K.C>0.03, is fulfilled.

The reactor was sealed and afterwards, 90g of liquid carbon dioxide were introduced into the reactor via the needle valve. The reactor was subsequently placed in a thermostatic bath at 120° C. The initial pressure in the reactor was 60 bar and after a period of approximately 10 min the pressure was 300 bar. The cotton was dyed for 4 hours at 120° C. and 300 bar. Subsequently, the reactor was removed from the thermostatic bath and cooled down till the pressure was 60 bar. At this pressure the reactor was depressurized by opening the needle valve.

The piece of cotton was removed from the reactor and was found to display an evenly distributed yellow colour. No traces of the pre-treatment fluid media or co-solvent were found in the piece of cotton, i.e. the cotton was completely dry after the dyeing process. Furthermore, no damage on the cotton fibers was observed due to the presence of acid.

To determine the fixation of the dye in the piece of cotton, a Soxhlet extraction was carried out. A half piece of the dyed cotton was extracted for 1 hour in a 15:35 (v/v) mixture of water and acetone at 85° C. The colour intensity, in terms of the K/S, was determined in the dyed and the extracted piece of cotton. The Kubelka-Munk equation, $K/S=(1-R)^2/2R$, is used to determine the colour intensity in the dyed and the extracted piece of cotton. In this equation R is the minimum value of the reflectance curve, which is measured between 350 and 750 nm with a spectrophotometer. The results showed a K/S value of the dyed cotton of 24.0 and a K/S value of the extracted cotton of 17.4.

Example 2

The experimental procedure described in example 1 was applied to 0.25 g of mercerized cotton. In this experiment the acid was $CH_3COOH$ in a concentration of 4545 mol% calculated on the molar amount of the reactive dye substance, so the requirement, K.C≧0.03, is fulfilled.

The result after 4 h dyeing was a yellow piece of cotton that was evenly dyed.

The K/S value after dyeing was 17.5 and K/S after extraction was 17.3, corresponding to an excellent fixation of 98%.

Example 3

The experimental procedure described in example 1 was applied to 0.25 g of mercerized cotton. In this experiment the dye used was (4-fluoro-6-methoxy-N-[4-(phenyldiazenyl) phenyl]-1,3,5-triazin-2-amine) and $H_3PO_4$ was the acid at a concentration of 10% mol calculated on the molar amount of reactive dye substance, so the requirement, K.C≧0.03, is fulfilled The result after 4 h dyeing was a yellow piece of cotton that was evenly dyed.

The K/S value after dyeing was 17.8 and K/S after extraction was 14.5.

Example 4

The experimental procedure described in example 1 was applied to 0.25 g of mercerized cotton. In this experiment the dye used was (4-fluoro-6-methoxy-N-[4-(phenyldiazenyl) phenyl]-1,3,5-triazin-2-amine). The co-solvent was methanol at a concentration of 2% by weight of carbon dioxide. The concentration of $H_3PO_4$ was 4% mol calculated on the molar amount of reactive dye substance.

The result after 4 h dyeing was a yellow piece of cotton that was evenly dyed. The K/S value after dyeing was 26.5 and K/S after extraction was 20.4.

Comparative Example A

Example 1 was repeated, except that no acid was employed during the dyeing and the co-solvent was methanol.

The dyed cotton piece so obtained was found to be evenly dyed. The K/S values observed were 15.5 after dyeing and 12.3 after extraction.

Comparative Example B

Comparative Example A was repeated, using a different reactive disperse dye, i.e. 6-chloro-N-[4-(phenyldiazinyl) phenyl]-1,3,5-trazin-2,4-diamine.

The dyed piece of cotton was found to be evenly dyed. For the aminomonochloro-triazinyl dye the K/S values were 11.1 after dyeing and 5.2 after extraction. The comparison of the results obtained in this experiment with those described in comparative example A demonstrate that not only the colour yield obtained with the aminomonofluorotriazinyl dye but also the fixation are superior to that of the aminomonochlorotriazinyl dye.

Comparative Example C

Example 4 was repeated, except that no acid was employed during the dyeing. Furthermore, the dyeing time was increased to 7 hours.

The dyed cotton piece so obtained was found to be evenly dyed. The K/S values observed were 15.6 after dyeing and 10.1 after extraction.

The invention claimed is:

1. A method of dyeing a substrate comprising:

contacting a substrate having reactive groups with supercritical or near supercritical carbon dioxide comprising a reactive dyestuff and at least 0.05 mol. %, calculated on the molar amount of reactive dyestuff, of one or more acids selected from the group consisting of HCl, $C_6H_5SO_3H$, $HNO_3$, $CF_3COOH$, $H_3PO_3$, $HClO_2$, $H_3PO_4$, $CH_2ClCOOH$, HF, $HNO_2$, HCOOH, and $C_6H_5COOH$, wherein the reactive dyestuff comprises a chromophore derivative having a chromophoric residue and a reactive group.

2. The method of claim 1, wherein the substrate comprises a fibre selected from the group consisting of cellulose fibre; modified cellulose fibre; protein fibre; synthetic fibre; or combinations thereof.

3. The method according to claim 2, wherein the fibre is selected from the group consisting of cotton, wool, silk, polyester, nylon, rayon and combinations thereof.

4. The method of claim 1, wherein the reactive groups of the substrate is selected from the group consisting of hydroxyl, thiol, primary and secondary amine.

5. The method of claim 1, wherein the reactive groups of the chromophore derivative is a cyclic or heterocyclic aromatic residue.

6. The method according to claim 5, wherein the cyclic or heterocyclic aromatic residue is substituted with at least one radical selected from the group consisting of halide, substituted or unsubstituted alkoxy, substituted or unsubstituted amine, and substituted or unsubstituted thiol.

7. The method according to claim 6, wherein the reactive dyestuff is represented by the formula (I):

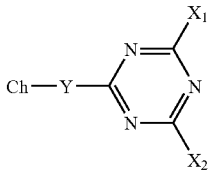

wherein

Ch represents a chromophoric residue;

Y represents O or NR, in which R represents hydrogen or a $C_1$-$C_8$ alkyl, which is optionally substituted by hydroxy, cyano, chloro, bromo, $C_1$-$C_5$ alkoxy, phenoxy, phenyl or phenoxy $C_1$-$C_4$ -alkoxy;

$X_1$ represents a halide;

$X_2$ represents fluorine, chlorine, $OR_1$, $SR_1$, $N(R_2)R_3$ or $P(O)(OH)R_4$;

$R_1$ represents hydrogen, or a $C_1$-$C_4$ alkyl, which is optionally substituted by hydroxy, cyano, fluorine, chlorine or bromine;

$R_2$ and $R_3$ independently represent hydrogen, $P(O)(OH)R_4$ or a $C_1$-$C_3$ alkyl which is optionally substituted by hydroxy, cyano, fluorine, chlorine or bromine; and $R_4$ represents hydroxy, fluorine, chlorine or bromine.

8. The method of claim 1, wherein the supercritical or near supercritical carbon dioxide further comprises between 1 and 35% by weight of carbon dioxide of a co-solvent selected from the group consisting of $C_1$-$C_6$ alkanols, dimethyl sulfoxide, dimethylformamide, acetone, butan-2-one, dimethyl ether, methyl acetate and ethyl acetate.

9. The method according to claim 1 further comprising, prior to contacting the substrate with supercritical or near supercritical carbon dioxide, treating the substrate with a fluid medium of which at least 10 wt. % is an organic hydrogen bond acceptor compound with 1-10 carbon atoms having one or more functionalities selected from hydroxyl, ester, ketone, sulfoxide, sulfone, ether, amine oxide, tertiary amide, phosphate, carbonate, carbamate, urea, phosphine oxide and nitrile.

10. The method according to claim 9, wherein the fluid medium contains at least 40 wt. % of the one or more organic hydrogen bond acceptor compound with 1-10 carbon atoms.

11. The method according to claim 9, wherein the hydrogen bond acceptor is selected from the group consisting of $C_1$-$C_6$ alkanols, dimethyl sulfoxide, dimethylformamide, acetone, butan-2-one, dimethyl ether, methyl acetate and ethyl acetate.

12. The method according to claim 9, wherein the hydrogen bond acceptor is selected from the group consisting of methanol, ethanol, propanol, iso-propanol, n-butanol and 2-butanol.

13. The method according to claim 9, wherein the hydrogen bond acceptor compound is in an amount of at least 30% by weight of the substrate.

14. The method according to claim 13, wherein the hydrogen bond acceptor compound is in an amount of at least 50% by weight of the substrate.

15. The method according to claim 1, wherein the one or more acids is in a concentration of at least 0.2 mol. %, calculated on the molar amount of reactive dyestuff.

16. The method according to claim 1, wherein the one or more acids exhibit an acid dissociation constant K at 25° C. within the range of $4\times10^{-7}$ to $1\times10^{7}$ .

17. The method according to claim 16, wherein the one or more acids exhibit an acid dissociation constant K at 25° C. within the range of $7.2\times10^{-4}$ to $6\times10^{-1}$.

18. The method according to claim 16, wherein the one or more acids has $K\times C\geqq0.03$; wherein C represents the molar concentration of dissolved acids in the carbon dioxide.

19. A method of dyeing a substrate comprising contacting the substrate with a composition consisting of:

(a) supercritical or near supercritical carbon dioxide:

(b) a reactive dyestuff comprising a chromophore derivative having a chromophoric residue and a reactive group;

(c) between 1 and 35% by weight of carbon dioxide of a co-solvent selected from the group consisting of $C_1$-$C_6$ alkanols, dimethyl sulfoxide, dimethylformamide, acetone, butan-2-one, dimethyl ether, methyl acetate and ethyl acetate; and (d) at least 0.05 mol. % $CH_3COOH$, calculated on the molar amount of reactive dyestuff.

20. The method of claim 19, wherein the $C_1$-$C_6$ alkanol is ethanol.

* * * * *